United States Patent [19]

Hall

[11] 4,286,719

[45] Sep. 1, 1981

[54] CANTILEVER STORAGE RACK

[75] Inventor: Lee Z. Hall, Huntington Woods, Mich.

[73] Assignee: Palmer-Shile Company, Detroit, Mich.

[21] Appl. No.: 97,682

[22] Filed: Nov. 27, 1979

[51] Int. Cl.[3] ..... A47F 5/00

[52] U.S. Cl. ..... 211/193; 211/190

[58] Field of Search ..... 211/193, 191, 190, 189, 211/208; 248/243; 108/108

[56] References Cited

U.S. PATENT DOCUMENTS

| | | | |
|---|---|---|---|
| 3,212,648 | 10/1965 | Baker et al. | 211/193 |
| 3,550,785 | 12/1970 | Seiz | 108/108 X |
| 3,602,374 | 8/1971 | Alabaster | 211/193 |
| 3,794,183 | 2/1974 | Colbridge | 211/208 |

*Primary Examiner*—Ramon S. Britts
*Assistant Examiner*—Robert W. Gibson, Jr.
*Attorney, Agent, or Firm*—Harness, Dickey & Pierce

[57] ABSTRACT

A cantilever storage rack having posts with vertically spaced rectangular apertures and arms having U-shaped brackets embracing the posts. Each bracket has two pairs of vertically spaced rectangular apertures so that two pins connect the bracket and post. The lower bracket apertures are spaced slightly rearwardly of the upper apertures in a direction away from the face of the column. The result is that the cantilever arm is supported by the pins with area contact but is held away from the column, thereby insuring accurate vertical arm location.

5 Claims, 3 Drawing Figures

CANTILEVER STORAGE RACK

BACKGROUND OF THE INVENTION

1. Field of the Invention

The invention relates to cantilever storage racks for industrial use, and has particular application to cantilever racks used in conjunction with automatic stackers in which it is necessary to have accurate vertical arm location with respect to a base plane.

2. Description of the Prior Art

Baker et al U.S. Pat. No. 3,212,648 shows a cantilever storage rack having a pair of columns with vertically spaced apertures, arms with U-shaped brackets embracing the columns, and pins passing through apertures in the columns and brackets. Inclined edges on the bracket apertures create a wedging action of the brackets against the columns.

While the area contact of the pins and apertures, and the wedging action, of this cantilever rack have important advantages, it has been found that due to tolerance variations in the aperture locations, substantial variations in vertical height of the arms with respect to a horizontal base plane are not unusual. While this phenomenon is not worrisome if manually controlled loading and unloading of the cantilever storage racks takes place, the vertical distances of the arms from a base plane become quite important when loading and unloading is done with an automatic stacker. Conventionally, this type of stacker has a proximity indicator, for example on a mast, for each elevation. This means that for proper operation of the stacker, the cantilever arms at any level throughout the entire system must be substantially at the same vertical distance from a base plane.

BRIEF SUMMARY OF THE INVENTION

It is an object of the present invention to provide a novel and improved cantilever storage rack construction which overcomes the difficulty described above associated with the construction of the aforementioned patent, and which ensures that the cantilever arms at any level will all be very close to an exact predetermined height after they are mounted on the column.

It is another object to provide an improved cantilever rack construction of this nature which still retains the strength qualities of the cantilever rack shown in the aforementioned Baker et al patent in terms of area contact between the pin and the bracket and column apertures.

It is another object to provide a novel cantilever rack construction of this nature which is capable of utilizing existing columns of the type shown in the aforementioned patent, and may also utilize tooling intended for the manufacture of said previous rack.

Other objects, features and advantages of the invention will be found in the following specification and claims as well as the accompanying drawings.

Briefly, the invention comprises, in a cantilever rack of the type having a pair of columns of rectangular cross-sectional shape, pairs of vertically spaced apertures in the sides of each column, a load supporting arm, and a channel shaped bracket having a web secured to the inner end of said arm and flanges adapted to fit around said column, the improvement comprising upper and lower pairs of apertures in the flanges of each bracket aligned with apertures in said column, and a pair of pins passing through the apertures in said bracket and column, the pins and apertures being so shaped and positioned that the web of the said channel shaped bracket will be spaced from said column and both pins will have area load bearing contact with said column and bracket.

DESCRIPTION OF THE PREFERRED EMBODIMENT

Figure 1:
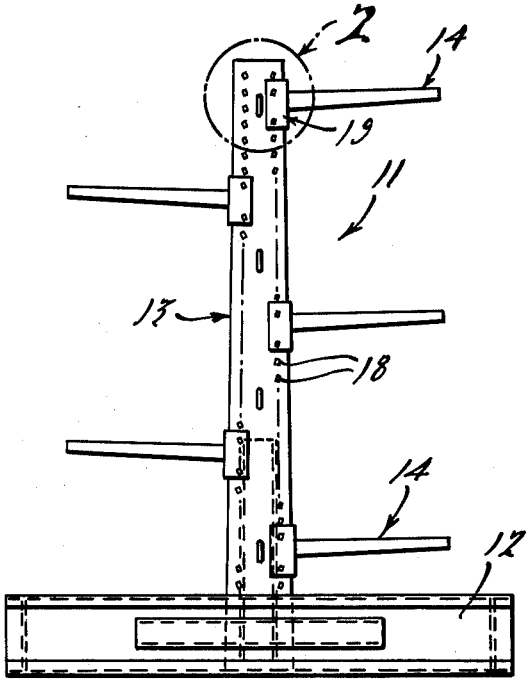
FIG. 1 is a side elevational view of a cantilever storage rack constructed in accordance with the principles of this invention.
Figure 3:
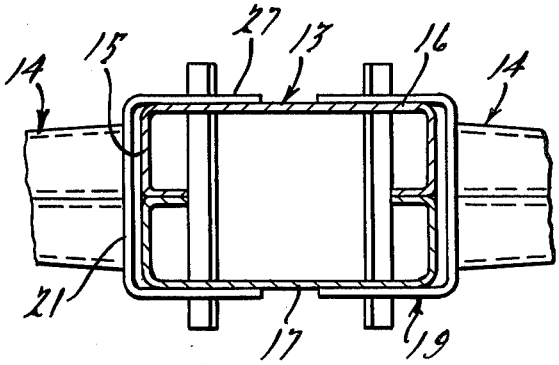
FIG. 3 is a fragmentary top plan cross-sectional view of a column and bracket.

The cantilever storage rack is generally indicated at 11 and comprises a base 12 for each of two or more columns generally indicated at 13. The columns and bases are constructed similarly to those described in the aforementioned Baker et al U.S. Pat. No. 3,212,648. In particular, the column is of rectangular cross-sectional shape as shown in FIG. 3 and may be adapted to support cantilever arms generally indicated at 14, either on one side only or on both sides. For each set of arms 14, the column has a facing web 15 and sides 16 and 17. Apertures 18 are formed in sides 16 and 17 as aligned pairs, the pairs being vertically spaced. Each aperture is of rectangular cross-sectional shape and is shown as being inclined, that is, with their side edges extending downwardly and away from the web 15 of the column which faces arms 14. This is the arrangement shown in aforesaid patent, and is illustrated herein to demonstrate that the present invention is adapted for use with existing columns which are so constructed.

Each arm 14 is shown as being of tapered construction, and is provided with a mounting bracket generally indicated at 19 secured to its inner end. Each bracket comprises a channel shaped member, the web portion 21 of which is secured to the wider end of arm 14 with the sides being adapted to fit around the sides 16 and 17 of the column.

A pair of upper apertures 22 and lower apertures 23 are formed in the flanges 27 of each bracket 19. These apertures are shown as being rectangular and are inclined in the same manner as apertures 18. They are spaced apart such that, when the bracket is placed on a column, they will be aligned with pairs of apertures in the column. As shown, they are aligned with alternate pairs of apertures to provide greater strength in the connection.

Pins 24 and 25 are provided for securing bracket 19 to column 13. Each pin is of rectangular cross-sectional shape so that there will be area load contact between the pin and the edges of the apertures in the column and bracket.

Figure 2:
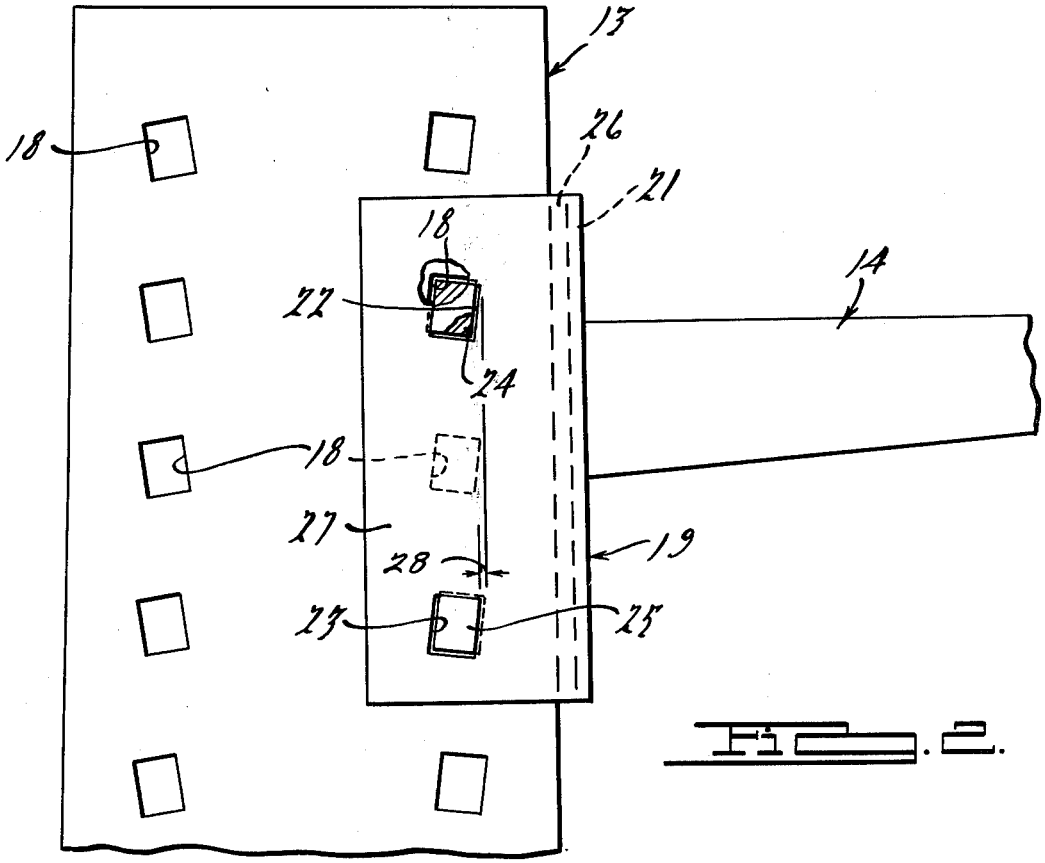
FIG. 2 is an enlarged fragmentary view taken in the area marked 2 of FIG. 1 and showing details of the bracket construction.

The invention contemplates mounting the bracket 19 on column 13 in such a way that a gap 26 exists between web 15 of the column and web 21 of the bracket. In order to accomplish this, the apertures 22 and 23 are so located relative to each other and to web 21 that loading forces will occur on the side of apertures 22 remote from web 21 and on the side of apertures 23 nearest web 21. This condition is shown in FIG. 2, wherein it will be seen that the vertical load is taken by the upper edges of apertures 22. Since the aperture positions may be closely controlled during manufacture, this will mean that the vertical location of each arm 14 with respect to base 12 or any other horizontal plane of reference, may be closely controlled. Vertical loads may also be placed on the upper edges of apertures 23, although by obviating this necessity, accuracy of vertical locations is further assured.

Apertures 22 and 23 in bracket 19 may be shaped similarly to apertures 18 in the column, that is, slightly larger than pins 24 and 25 for easy insertion. In order to maintain arm 14 perpendicular to column 13, apertures 23 are shifted a slight distance away from web 21, with respect to apertures 22, this distance being indicated at 28 in FIG. 2.

By avoiding the wedging action of the aforementioned Baker et al patent, which made it difficult to control vertical position of the load support arm, accurate height may be obtained while still retaining the pin area loading feature of said patent. Since the load transmitting function of the wedging, described in the previous patent, is not available with the present invention, adjustment of load ratings or required parts dimensions will be made.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. In a cantilever storage rack of the type having a column of rectangular cross-sectional shape, pairs of vertically spaced apertures in the sides of the column, a load supporting arm, and a channel shaped bracket secured to the inner end of said arm and adapted to fit around said column, the improvement comprising upper and lower pairs of apertures in the flanges of each bracket aligned with apertures in said column, and a pair of pins passing through the apertures in said bracket and column, the pins and apertures being so shaped and positioned that the web of the said channel shaped bracket will be spaced from said column and both pins will have area load bearing contact with said column and bracket.

2. A cantilever storage rack comprising a column of rectangular cross-sectional shape, pairs of vertically spaced apertures in the sides of said column, a load supporting arm, a channel shaped bracket having a web secured to the inner end of said arm and flanges adapted to fit around said column, upper and lower pairs of apertures in the flanges of said bracket aligned with apertures in said column, and a pair of pins passing through the apertures in said bracket and column, the pins and apertures being so shaped and positioned that the web of the said channel shaped bracket will be spaced from said column and both pins will have area load bearing contact with said column and bracket.

3. The combination according to claims 1 or 2, the lower pair of apertures in said bracket being located away from the bracket web with respect to the upper pair of apertures.

4. The combination according to claims 1 or 2, said pairs of apertures in the bracket being rectangular.

5. The combination according to claim 4, said pairs of apertures in the column being rectangular.

* * * * *